US009434513B2

(12) United States Patent
Lux et al.

(10) Patent No.: US 9,434,513 B2
(45) Date of Patent: Sep. 6, 2016

(54) RESEALABLE PACKAGING ARTICLES AND METHODS OF MAKING AND USING THEREOF

(71) Applicant: NuLabel Technologies, Inc., East Providence, RI (US)

(72) Inventors: Benjamin D. Lux, Providence, RI (US); Ashley M. Mudd, Providence, RI (US); Heidi M. Munnelly, Cumberland, RI (US)

(73) Assignee: Nulabel Technologies, Inc., East Providence, RI (US)

( * ) Notice: Subject to any disclaimer, the term of this patent is extended or adjusted under 35 U.S.C. 154(b) by 0 days.

(21) Appl. No.: 14/539,772

(22) Filed: Nov. 12, 2014

(65) Prior Publication Data

US 2015/0131926 A1 May 14, 2015

Related U.S. Application Data

(60) Provisional application No. 61/903,106, filed on Nov. 12, 2013.

(51) Int. Cl.
*B29D 22/00* (2006.01)
*B65D 33/24* (2006.01)
(Continued)

(52) U.S. Cl.
CPC ..... *B65D 33/24* (2013.01); *B65D 27/16* (2013.01); *B65D 33/1691* (2013.01);
(Continued)

(58) Field of Classification Search
CPC .. B32B 27/08; B65D 75/5855; B65D 33/24; B65D 77/14; B65D 27/16; B65D 75/5833; B65D 75/5838; B65D 33/1691; B65D 33/20; B65D 77/2096; B65D 2575/586
See application file for complete search history.

(56) References Cited

U.S. PATENT DOCUMENTS 3,289,386 A 12/1966 Farmer
3,531,316 A 9/1970 Sternasty
(Continued)

FOREIGN PATENT DOCUMENTS

EP 1783059 5/2007
EP 2361760 8/2011
(Continued)

OTHER PUBLICATIONS

Balzer, et al., "Cohesion mechanisms of polystyrene-based thin polymer films" Macromolecules, 46:7406-14 (2013).
(Continued)

*Primary Examiner* — James Yager
(74) *Attorney, Agent, or Firm* — Pabst Patent Group LLP

(57) ABSTRACT

Resealable systems for consumer packaging, such as food packaging, are described herein. The system includes one or more anchor points and one or more cling coatings. The anchor points can be introduced into or onto the packaging material during manufacture, such as by co-extrusion. Alternatively, the anchor points can be affixed to the packaging material after manufacture, such as with a pressure sensitive adhesive. The cling coatings can be applied to the packaging material during or after manufacture. For example, the cling coatings can be spot coated or pattern coated onto the desired location. The cling coatings are selective, that is they do not attach to themselves but only attach to the anchor point. The cling coatings transfer little or no material over time resulting in more consistent performance over time than pressure sensitive adhesives.

14 Claims, 3 Drawing Sheets

(51) Int. Cl.

| | |
|---|---|
| ***B65D 77/14*** | (2006.01) |
| ***B65D 27/16*** | (2006.01) |
| ***B65D 75/58*** | (2006.01) |
| ***B65D 33/16*** | (2006.01) |
| ***B65D 33/20*** | (2006.01) |
| ***B65D 77/20*** | (2006.01) |

(52) U.S. Cl.

CPC ..... *B65D 33/20* (2013.01); *B65D 75/5833* (2013.01); *B65D 75/5838* (2013.01); *B65D 75/5855* (2013.01); *B65D 77/14* (2013.01); *B65D 77/2096* (2013.01); *B65D 2575/586* (2013.01)

(56) References Cited

U.S. PATENT DOCUMENTS

| | | | | |
|---|---|---|---|---|
| 4,334,431 | A | 6/1982 | Kohno | |
| 4,519,095 | A | 5/1985 | Clayton | |
| 4,584,201 | A * | 4/1986 | Boston | 426/106 |
| 5,089,320 | A | 2/1992 | Straus | |
| 5,162,138 | A | 11/1992 | Caflisch | |
| 5,334,431 | A | 8/1994 | Longtin | |
| 5,403,025 | A | 4/1995 | Shanley | |
| 5,417,790 | A | 5/1995 | Petrou | |
| 5,628,858 | A | 5/1997 | Petrou | |
| 6,020,062 | A | 2/2000 | Questel | |
| 6,054,006 | A | 4/2000 | Pilon | |
| 6,210,795 | B1 | 4/2001 | Nelson | |
| 6,298,894 | B1 | 10/2001 | Nagamoto | |
| 6,306,242 | B1 | 10/2001 | Dronzek | |
| 6,502,986 | B1 | 1/2003 | Bensur | |
| 6,517,664 | B1 | 2/2003 | Dronzek, Jr. | |
| 6,519,885 | B2 | 2/2003 | Valiulis | |
| 6,656,319 | B1 | 12/2003 | Boyd | |
| 6,663,746 | B2 | 12/2003 | Dronzek | |
| 6,667,086 | B2 | 12/2003 | Dronzek, Jr. | |
| 6,749,710 | B2 | 6/2004 | Preston | |
| 7,892,598 | B1 | 2/2011 | Dronzek | |
| 7,943,714 | B2 | 5/2011 | Schnieders | |
| 7,963,413 | B2 | 6/2011 | Sierra-Gomez | |
| 8,091,323 | B2 | 1/2012 | Paterson | |
| 8,334,335 | B2 | 12/2012 | Lux | |
| 8,334,336 | B2 | 12/2012 | Lux | |
| 2001/0037594 | A1 | 11/2001 | Bohen | |
| 2001/0047161 | A1 * | 11/2001 | Wong et al. | 604/407 |
| 2003/0039412 | A1 * | 2/2003 | Rodick | B65D 33/1691 383/211 |
| 2004/0221944 | A1 | 11/2004 | Havard | |
| 2005/0031233 | A1 | 2/2005 | Varanese | |
| 2005/0277358 | A1 | 12/2005 | Isenberg | |
| 2007/0232497 | A1 | 10/2007 | Chew | |
| 2011/0033698 | A1 | 2/2011 | Woods | |
| 2011/0097023 | A1 * | 4/2011 | Moehlenbrock | 383/116 |

FOREIGN PATENT DOCUMENTS

| | | |
|---|---|---|
| EP | 2551211 | 1/2013 |
| GB | 1333710 | 10/1973 |
| WO | 9734810 | 9/1997 |
| WO | 9919412 | 4/1999 |
| WO | 0214448 | 2/2002 |

OTHER PUBLICATIONS

Breard, "Hanging on through thick and thin: A look at static-cling vinyls" , Screenprinting Magazine, pp. 1-9, Mar. 2005.

Jin, et al., "Challenges and solutions for joining polymer materials," Macromol. Rapid Commun., 35:1551-70 (2014).

Randow, et al., "An investigation of the cling of thin polymeric films," J. Adhesion, 63: 285-307 (1997).

International Search Report, PCT application PCT/US2013/059456, mailed Jan. 16, 2014.

International Search Report, PCT application PCT/US2014/065278, mailed Feb. 20, 2015.

International Search Report, PCT application PCT/US2014/065278, mailed Apr. 28, 2015.

* cited by examiner

RESEALABLE PACKAGING ARTICLES AND METHODS OF MAKING AND USING THEREOF

CROSS-REFERENCE TO RELATED APPLICATION

This application claims priority to U.S. Provisional Application No. 61/903,106, filed in the U.S. Patent and Trademark Office on Nov. 12, 2013, the disclosure of which is incorporated herein by reference in its entirety.

FIELD OF THE INVENTION

This invention is in the field of systems for resealable consumer packaging, such as food packaging.

BACKGROUND OF THE INVENTION

Adhesive type closure arrangements have been used to seal and/or close plastic bags such as those used for sandwiches, garbage containers, and the like.

U.S. Pat. No. 4,519,095 to Clayton describes a resealable flexible thermoplastic bag wherein the closure comprises at least one female channel member or strip affixed to the bag and having a pressure sensitive adhesive (PSA) layer on an internal portion of the channel strip. During shipment and storage the walls of the channel hold the pressure sensitive adhesive layer away from adjacent surfaces to prevent inadvertent sticking. Sealing of the bag is achieved by contacting the channel strip with a surface of the bag and exerting pressure along the strip whereby the pressure sensitive adhesive is contacted with a substantially flat portion of the surface and adhered thereto.

Clayton also describes a resealable plastic bag containing a channel with the adhesive layer positioned on a flap of the bag, a channel with the adhesive positioned on the body of the bag over which the flap will fold, and two female channel strips positioned on opposite sides of a bag opening to affect a double seal by pressing the two channels into contact such that one wall or bead of each channel is contacted by the adhesive layer in the opposing channel.

U.S. Pat. No. 6,502,986 to Bensur et al. describes a product package with a resealable end closure. The package is heat-sealed to form permanent fin-seals at its end closure, where the ends of a flexible sheet are heat-sealed together and the sheet may contain one or more layers. A resealable seal is formed adjacent to the permanent seal at one end of the package. The resealable seal is formed by a PSA placed on a first interior region of the package. The PSA is covered with a heat seal coating. Another heat seal coating is applied to a second interior region of the package. The two interior regions with the heat seal coatings are then sealed to form an initial resealable seal. Upon opening the package from the end seal adjacent to the initial resealable seal, and pulling apart the resealable seal, the PSA dislodges from the first region and stays with the second region. The package is resealed by pressing the second region against the first region.

U.S. Pat. No. 5,089,320 to Straus et al. describes a resealable package where a PSA layer is coated onto a substrate layer used for flexible packaging. The adhesive layer may be coated only in the area where the package is to be opened or may be coextruded with the substrate layer throughout the film, and is further covered by and/or coextruded with a skin layer placed over the adhesive layer. The package is sealed to itself and when it is opened at the adhesive layer area it is broken apart at the skin layer, thus exposing the adhesive, either between the adhesive and skin layer, or between the substrate and adhesive, or both. The skin layer seals to itself, thus forming a fin seal arrangement.

U.S. Pat. No. 8,091,323 to Paterson describes a reclosable film structure for a package, in particular a reclosable lap seal, containing a multiple layer film with an interior PSA layer. The PSA layer is positioned between a first and a third layer on either side of the PSA layer and is continuous throughout the package. The package is heat sealed at an open end to initially close the package by folding over an outer lap seal segment onto an inner lap seal segment and heat-sealing together. Upon opening the package at the lap seal, the package delaminates between the first and second layers along one of the lap seal segments, thus exposing the pressure sensitive adhesive layer to facilitate reclosing the package. The exposed PSA is oriented away from the package interior and away from the food removal path to maintain the adhesion strength by avoiding food contact.

U.S. Pat. No. 7,963,413 to Sierra-Gomez et al. describes a container for a food product including a tamper-evident closure which forms an opening of a container. The closure contains a sealing layer, adhesively sealed to the top of the container around the opening. The sealing layer is releasable from the container by pulling back on the sealing layer and resealable against the top layer to seal the opening when the sealing layer is moved back against the top.

All of the packaging materials described above use a PSA as part of the adhesive and/or resealing system. The integrity of the pressure sensitive adhesive can be compromised when the food in the packaging contacts the adhesive. Attempts to overcome this include orienting the PSA away from the interior of the package. However, foods that produce crumbs, such as cookies, crackers, potato chips, etc. are still likely to adhere to the PSA compromising the adhesive system. PSA binding is also not selective; the PSA can adhere to potentially any surface of the package or contents of the package. Finally, the strength of the adhesion of the PSA decreases over time due to adhesive transfer.

There exists a need for an improved system for resealing articles that overcomes the limitations of PSA systems including contamination of the adhesive system by food or other consumer materials non-selectivity, diminished peel strength with reuse, and adhesive transfer.

Therefore, it is an object of the invention to provide improved resealable packaging materials, in particular, food packaging and other consumer packaging.

It is another object of the invention to provide a method for using improved resealable packaging materials, in particular, food and other consumer packaging.

It is another object of the invention to provide a kit for preparing improved resealable packaging materials, in particular, food and other consumer packaging.

SUMMARY OF THE INVENTION

Systems for resealable consumer packaging, such as food packaging and non-food packaging, or for use as closure materials other articles, are described herein. The system includes one or more anchoring points and one or more cling coatings. The anchoring points can be introduced into or onto the packaging material during manufacture, such as by extrusion or co-extrusion. Alternatively, the anchoring points can be affixed to the packaging material after manufacture, such as with a pressure sensitive adhesive, mechanical or ultrasonic fastening, or heat seal type adhesives. The cling coatings can be applied to the packaging material during or after manufacture. For example, the cling coatings can be spot, pattern, or flood coated onto the desired location of the packaging material or other article.

The cling coatings are selective, that is they do not attach to themselves or other materials, but selectively attach only to the anchoring point or site. The cling coatings transfer little or no material over time resulting in more consistent performance over time than pressure sensitive adhesives. The selectivity of the cling coating only for the anchoring point ensures that is not susceptible to contamination by food or other materials, maintains its peel strength with reuse, and prevents or reduces transfer of material from the cling coating to the anchor point. The cling coatings may be formed from aqueous-based solutions, emulsions or dispersions of the polymer(s).

BRIEF DESCRIPTION OF THE DRAWINGS

FIG. 1A, the flap is not folded over the opening.

FIG. 2A, the top of the back is not over the opening.

FIG. 3A, the lid is contacted with the base to seal the package.

FIG. 4A, the bag is sealed.

FIG. 5A is a plan view of the packaging sheet unfolded.

DETAILED DESCRIPTION OF THE INVENTION

I. Definitions

Figure 1A:
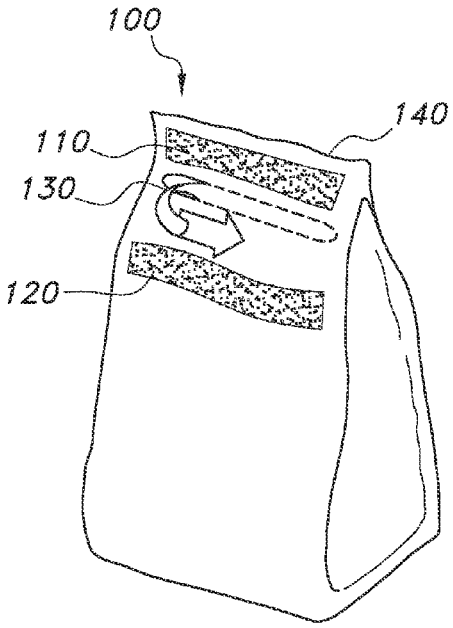
FIGS. 1A and B are representations of a bag having an anchoring point and a coating of a cling coating which are parallel to the opening of the bag.
Figure 1B:
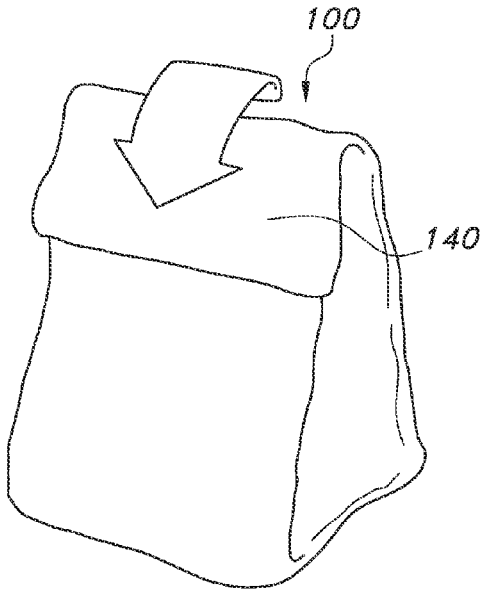
FIG. 1B, the flap is folded down to contact the cling coating to the anchor point in order to seal the bag.

"Resealable", as used herein, refers to a system designed to repeatedly or easily stick and unstick (attach and separate), for example in the opening and closing or sealing of an article, such as food packaging. In some embodiments, the resealable item can open and close 1 to 100 times or more, preferably at least 1-50 times, more preferably at least 1-25 times.

"Easily" as used herein generally means that the cling coating attaches to the anchoring site without additional pressure beyond hand application (i.e. no weighted rollers or mechanical devices needed). Cling coatings that easily unstick only require hand forces to unstick.

"Pressure sensitive adhesive" (PSA) is a term known in the art used to designate a distinct category of permanent or removable adhesives which in dry form (solvent/water free) are aggressively and permanently tacky at room temperature and that firmly adhere to a variety of dissimilar surfaces upon mere contact without the need of more than finger or hand pressure. These products require no activation by water, solvent, or heat in order to exert a strong adhesive holding force toward such materials as paper, plastic, glass, wood, cement, and metal. In some embodiments, the PSA has sufficient holding power and elastic nature so that it essentially, permanently affixes the anchoring site to the substrate.

"Cling coating" and "cling coating strip" refer to materials that temporarily attach to the anchor point. The coatings are capable of sticking to particular smooth surfaces, i.e. the anchoring site, in a wide range of environmental conditions, such as variable temperatures and humidity levels. The cling coating is selective, that is, it does not attach to itself or other materials, except via the anchor point. The cling coating and/or the material that is used to prepare the cling coating may contain one or more additives, such as stabilizers, surfactants, etc.

"Anchor point", "anchor strip" and "anchoring site" are used interchangeably, and refer to the portion of the packaging to which the cling coating attaches. The materials used to prepare the anchor point or site can be impregnated with plasticizers to introduce flexibility and pliability to the material as required.

"Cohesive forces" refers to intermolecular forces resulting from hydrogen bonding and van der Waals' forces.

"Non-blocking", as used herein, generally refers to a property of the interaction of two sides of a substrate that contains a cling coating on one side and a face side or other material on the opposite side of the substrate A substrate that contains a non-blocking cling coating does not attach to, form a bond with, or otherwise cause damage to the face side (i.e. the opposite site of the substrate) when the two sides are in contact with each other. This property allows the substrate to be rolled and unrolled or for sheets of the substrate to be stacked without damaging or otherwise modifying the face side (i.e. the opposite side) of the substrate.

The terms "packaging material(s)", "resealable packaging", and "packaging" are used interchangeably herein.

II. Resealable System

A system which allows for the repeated sealing and unsealing of packaging articles, such as bags, containers, etc, is described herein. In some embodiments, the packaging article is used to package food. The system can be used as a closure system with a variety of articles, such as a closure system in hand bags, pack packs, tents and/or accessories. The system includes an anchoring site or point which can be a part of the articles (e.g., co-extruded with the material or materials used to form the article) or can be applied to the article during or after manufacture. The system also includes a cling coating which selectively attaches to the anchor point or site via cohesive forces. The materials in the cling coating and anchor site are preferably selected to allow the cling coating to generally conform to the anchor site.

A. Anchoring Site/Point

The systems include an anchoring site that can be permanently incorporated into the packaging during manufacture or can be applied to the packaging during or after manufacture.

Typically, the materials used to form the anchoring sites include a combination of one or more polymers and one or more plasticizers. In one embodiment, the polymer to plasticizer ratios by weight for the materials used to form the anchoring site range from 20:80 to 80:20. In a more preferred embodiment, the polymer to plasticizer ratios by weight for the materials used to form an anchoring site range from 65:35 to 35:65. In the most preferred embodiment, the polymer to plasticizer ratios by weight range from 45:55 to 55:45.

Optionally anchoring site includes one or more additional materials, such as mold-releasing materials, lubricants, anti-oxidants, color stabilizers, anti-static compounds, anti-fog compounds, anti-moisture compounds, pigments, and/or colorants, etc.

i. Polymers

Suitable polymers for the anchoring site include, but are not limited to, polyvinyl chloride, nylon, silicone, butyl rubber, ethylene propylene diene monomer rubber, viton rubber, neoprene rubber, polyurethane, polyethylene, polypropylene, polyethylene terephthalate, ethylene-vinylacetate copolymers, polystyrene, polyvinyl butyral, non-carboxylated and carboxylated styrene-butadiene rubbers, polyvinyl acetates, polyacrylates based on the polymerization of monomers of methacrylates, methyl acrylate, ethyl acrylate, 2-chloroethyl vinyl ether, 2-ethylhexyl acrylate, hydroxyethyl methacrylate, butyl acrylate, butyl methacrylate or combinations of the previous, polyamides, polyesters, polyolefins, polyolefins containing maleic anhydride, polystyrenes, polyvinyl esters, polyvinyl ketones, polydiene elastomers, polyiso butylenes, poly butadienes, polychloroprenes, poly styrene acrylics, carboxylated acrylic, styrene-butadiene polymers, and combinations thereof.

ii. Plasticizers

The anchoring site materials can include one or more plasticizers. The plasticizers modulate the flexibility and pliability of the anchoring site material. Suitable plasticizers include, but are not limited to, Plasthall series (from Hallstar), such as diisobutyl adipate and diisodecyl adipate, acetyl tributly citrate, di-isononyl-cyclohexane-1,2-dicarboxylate, dioctyl terephthalate, dioctyl phthalate, epoxidized soybean oil, tri-2-ethylhexyl trimellitate, acetylated monoglycerides of fully hydrogenated castor oil, bis(2-ethylhexyl)-1,4-benzenedicarboxylate, di(2-ethyl hexyl) adipate, di-butyl adipate, butylated hydroxytoluene, hyperbranched poly(ϵ-caprolactone), di(2-ethylhexyl)phosphate, 2,2,4-trimethyl 1,3-pentanediol diisobutyrate, dioctyl sebacate, and di-butyl sebacate, because they are less volatile and migratory so less hazardous, Other plasticizers can also be used.

Altering the molecular weight and/or modifying the steric bulk of functional groups on the plasticizer molecules can control the migration of the plasticizer. A higher molecular weight and/or the presence of bulky functional groups results in slowless migration while a lower molecular weight and/or less bulky (or linear) groups result in a faster/higher degree of migration. Slowless migration of plasticizer provides for more temporary attachment to the anchoring site. Fast/high migration of plasticizer provides for more permanent attachment to the anchoring site "Internal plasticizer" refers to plasticizers covalently bonded to the polymer, while "external plasticizers" are added to the polymeric mixture but are not physically bonded to the polymer. Internal plasticizers have lower degree of migration than external plasticizers.

iii. Substrates

The anchoring site can be permanently affixed to, or incorporated into or onto, a variety of substrates manufactured from a variety of materials. In some embodiments, the substrate is prepared from paper or coated paper, cardboard or coated cardboard, plastic, glass, wood, cement, metal, or combinations thereof. In particular embodiments, the substrate, or the portion of the substrate, to which the anchoring site is affixed is plastic (e.g., PE, PET, etc.). In certain embodiments, the anchoring site can be manufactured into the desired substrate and be a permanent feature of the substrate. In other embodiments, the substrate can act as the anchoring site. This is particularly applicable to certain plasticized plastics, including, but not limited to, PVC.

In some embodiments, the substrate is a fabric. Any material can be used, such as woven materials, non-woven materials, natural materials (e.g. cotton, wool, linen, silk or mixtures thereof), synthetic materials, or combinations thereof.

iv. Hardness

The hardness of the anchoring site can be measured by any suitable means. In the Examples, the hardness was measured using a Rex durometer model 1000 A, on a sample size of ten. In one embodiment the hardness ranges from Shore A40-75. In a more preferred embodiment, the hardness ranges from Shore A45-65. In the most preferred embodiment, the hardness ranges from Shore A50-60.

B. Cling Coating

The system also contains one or more cling coatings on the article, which attaches to the anchoring site(s) or point (s). The cling coatings can be spot coated or pattern coated onto the surface of the article in any configuration. For example, the cling coating can be applied as a strip or a pattern in a configuration that matches the configuration of the anchoring site or point. Other techniques for applying the cling coating to the article include, but are not limited to, spray, gravure, slot die, flexography, curtain coating, and rod methods.

i. Polymers

Suitable coatings materials include, but are not limited to, polyvinyl alcohols, polyvinyl acetates, polyvinylpyrrolidones, polyvinylpyrrolidone-vinyl acetate copolymers, polyacrylic acids, polyethylene glycols, poly(2-ethyl-2-oxazoline), polyacrylamide copolymers, ethylene vinyl acetates, natural and reclaimed rubbers, polyurethanes, non-carboxylated and carboxylated styrene-butadiene rubbers, polyacrylates based on the polymerization of monomers of methacrylates, methyl acrylate, ethyl acrylate, 2-chloroethyl vinyl ether, 2-ethylhexyl acrylate, hydroxyethyl methacrylate, butyl acrylate, butyl methacrylate or combinations of the previous, polyamides, polyesters, polyolefins, chlorinated-polyolefins, polyolefins containing maleic anhydride, polystyrenes, polyvinyl esters, polyvinyl ketones, polydiene elastomers, polyiso butylenes, poly butadienes, polychloroprenes, polystyrene acrylics, styrene maleic anhydride resins, carboxylated acrylics, styrene and/or butadiene polymers, cellulose derivatives, particularly alkyl cellulose derivatives (cellulose acetate, methyl cellulose, ethyl/hydroxyethyl, hydroxymethylpropyl cellulose, etc.), ureas, gelatins, alginates, agars, gum arabics, as well as combinations of the above materials. The most preferred cling coating materials are polystyrene acrylics.

The material used to prepare the cling coating can contain the polymer only. Optionally the material for the cling coating contains one or more additives.

ii. Additives for the Cling Coating Material

Suitable additives include surfactants and other stabilizers that may be present when the material is purchased from a source. For example, some of the materials listed above may be sold as suspensions or emulsions which contain one or more additives to stabilize the emulsion or suspension (e.g., prevent aggregation).

Additional additives include but are not limited to defoamers, humectants, colorants, anti-static agents, surface friction modifying compounds, acids, bases, buffers, antimicrobial agents, defoaming agents, as needed for the particular application. Potential classes of additives include, but are not limited to, colorants, both dye and pigment based, salts, sugars, other carbohydrates, polyelectrolytes, proteins, dry and liquid surfactants, resins, wetting agents, humectants, polyethylene glycol, and/or salts, as well as combinations thereof.

The cling coating is non-blocking and does not attach or adhere to itself. The surface of the cling coating is smooth and interacts with the anchoring site via cohesive forces. A surface with a cling coating can be reapplied to the same anchoring site or another anchoring site, or a second different surface with a cling coating can be applied to the anchoring site.

III. Methods of Making

A. Incorporation of Anchoring Site(s) or Points(s) into or onto Packaging

In some embodiments, the anchoring site is introduced into or onto the substrate during manufacture of the substrate. For example, an anchoring site can be introduced into the packaging material, such as by co-extrusion of the anchoring site or point with the material or materials used to form the packaging. The anchoring site can also be applied via coating techniques such as spray coating, gravure, reverse gravure, slot die, flexography, and rod methods.

The anchoring site is typically flexible and can be co-extruded to a more rigid backing. In one embodiment, the anchoring site and the rigid backing are composed of the same materials with different degrees of flexibility.

In other embodiments, the anchoring site is affixed to the substrate during or after the substrate is manufactured. The anchoring site can be permanently affixed to the substrate using a variety of techniques in the art. In some embodiments, the anchoring site is permanently affixed to the substrate using an adhesive, such as a pressure sensitive adhesive.

Suitable pressure sensitive adhesives include, but are not limited to, acrylics, styrene butadiene resin, rubbers, and silicones, optionally in combination with one or more additives, such as tackifying resins, plasticizers, oils, antioxidants, etc. and combinations thereof.

In other embodiments, heat seal adhesives can be used to create a liner-free web of anchoring site material. This can be laminated to packaging material during its manufacture to form a permanent bond between the anchoring site and the packaging substrate.

In yet another embodiment, the anchoring site can be mechanically fastened to the packaging substrate. Applicable techniques for this are known to those skilled in the art and include riveting. This is particularly applicable to rigid and reusable packaging materials including, but not limited to shipping totes, mail cartons, and returnable distribution bins.

In other embodiments, the anchoring site is bonded to the packaging material using an ultrasonic technique. This is particularly applicable for certain low surface energy plastics commonly used in packaging products.

In those embodiments where the anchoring site or point is applied to the packaging during or after manufacture of the packaging, the anchoring site can be provided as a linered element with an adhesive (e.g. a pressure sensitive adhesive) coated on it with a liner. The linered anchoring sites provide end users the ability to permanently affix the anchoring site to a desired substrate. The adhesive is applied to the back side of the anchoring site. The initial step of the use of this linered anchoring site includes the removal of the liner followed by the application of the anchoring site to the packaging.

With the anchoring sites permanently affixed to an article, the article (e.g. packaging, bag, or other article) can be repeatedly opened and closed by contacting the anchoring site or point with the cling coating.

B. Application of Cling Coating to Packaging

The cling coating can be applied using a variety of techniques known in the art including, but not limited to, rod coating, spray coating, gravure or flexographic printing press, reverse gravure coating method, pattern encoded on gravure cylinder and cling coating applied directly to the packaging material of choice.

Suitable substrates/packaging materials include, but are not limited to, synthetic materials, such as polyolefins (e.g., polyethylene, low density polyethylene (TYVEK®), polypropylene), polyethylene terephthalate (PET), polyesters, polyvinyl chloride, polyvinylidene chloride, and combinations thereof; and materials derived from naturally occurring materials, such as paper (e.g., envelopes, such as manila envelopes or other paper-based packaging), paperboard, fiberboard, cardboard, and combinations thereof.

For low surface tension substrates, surface modification via corona treatment, atmospheric plasma treatment or primer can be used to increase attachment of the cling coating to the substrate.

IV. Applications

Resealable packaging materials are described herein. In some embodiments, the packaging materials are those that are used for a finite, short amount of time.

Alternatively, the systems can be incorporated in other articles by the methods described herein, for use as closure materials.

In particular embodiments, the resealable packaging material is disposable and/or recyclable. Examples of such resealable packaging materials include resealable packaging materials for food, such as deli meats, cookies and crackers, etc.

For example, a resealable packaging material contains one or more anchoring sites and one or more cling coatings on opposite sides of an opening on the resealable package. In this arrangement, the side with the cling coating may be folded over the opening to contact the anchoring site, thereby closing (or sealing) the opening. The package can be re-opened by peeling the side with the cling coating or anchoring site away from the opposite side with the anchoring site or cling coating, respectively (see, for example, FIGS. 1A and B).

Alternatively, the one or more anchoring sites and the one or more cling coatings are in the form of strips or a plurality of points on opposite sides of a flexible package, with an opening on one side. The top of the packaging material (e.g. a bag) may be rolled, bent, or folded or reconfigured by any suitable means to contact the cling coatings to the anchoring sites in order to seal the bag. The package can be re-opened by peeling the side with the cling coating or anchoring sites away from the opposite side with the anchoring sites or cling coating, respectively (see, for example, FIGS. 2A and B).

In another embodiment, the package may contain a removable flap that attaches to a base portion of the package. The base portion includes a hole or open portion that is covered by the flap, when the package is in the closed position. The flap is slightly longer and wider than the opening to allow the flap to fully cover the opening. The edge of the flap contains one or more anchoring sites or the one or more cling coatings. The edge, typically three sides, of the base portion that generally surrounds the opening contain the second material for the resealable system (i.e. one or more anchoring sites or the one or more cling coatings). The resealable package is closed by contacting the flap and the base. The resealable package is opened by peeling away the flap from the base (see, for example, FIGS. 3A and B).

In a further embodiment, the one or more cling coatings and the one or more anchoring sites are on opposite pairs of flaps on an end of a resealable package. The resealable package is closed or opened by contacting or peeling away (separating), respectively, the opposite pairs of flaps on the resealable package (see, for example, FIGS. 4A, B and C).

In a further embodiment, the resealable packaging material is a flat material (e.g. a sheet). One or more anchoring sites and one or more cling coatings may be located on opposite areas (e.g. opposite edges) of the material. The material is then folded, such that the area with the one or more anchoring sites contacts and mates with the area with the one or more cling coatings to form a resealable closure. The folded material may be further modified to forma pouch or other article, such as by forming permanent closures on any open sides of the article. The resealable package is closed or opened by contacting or peeling away (separating), respectively, the sides of the pouch with the one or more anchoring sites and one or more cling coatings (see, for example, FIGS. 5A and B).

Uses for the resealable system include non-food uses, such as health and beauty aid packaging, office supply packaging, packaging used as protective coverings during transport/storage of goods, such as consumer goods, latches for computer cases, handbags, back packs, etc.

Examples of resealable packaging are shown in FIGS. 1A, 1B, 2A, 2B, 3A, 3B, 4A, 4B, 4C, 5A and 5B. FIGS. 1A and B are representations of a bag 100 having an anchor point 120 and a coating of a cling coating 110 which are generally parallel to the opening of the bag 130. The flap 140 is folded down to contact the cling coating to the anchor point in order to seal the bag.

Figure 2A:
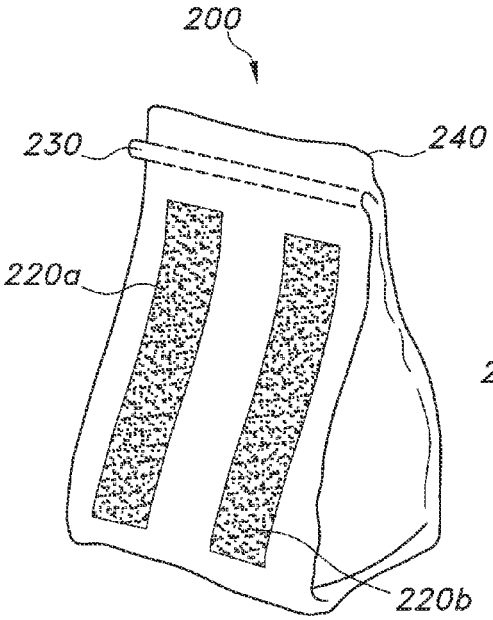
FIGS. 2A and B are representations of a bag having two anchor strips and a coating of a cling coating which are perpendicular to the opening of the bag.
Figure 2B:
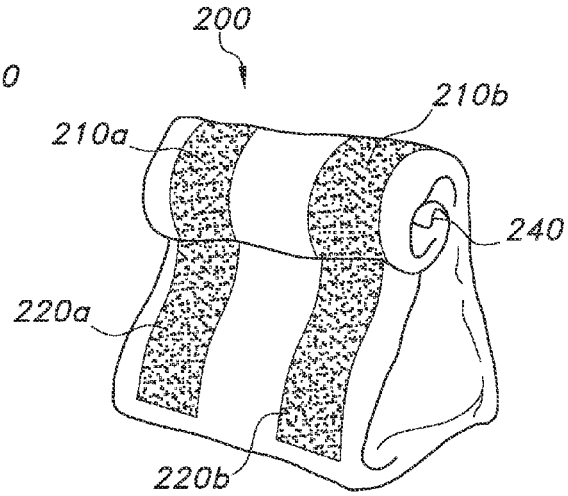
FIG. 2B, the top of the bag is rolled down to contact the cling coating to the anchor strip to seal the bag.

FIGS. 2A and B are representations of a bag 200 having two anchor strips 220*a* and 220*b* and coatings of cling coatings 210*a* and 210*b* which are generally perpendicular to the opening of the bag 230. The top of the bag 240 is rolled down to contact the cling coatings 210*a* and 210*b* to the anchor strips 220*a* and 220*b* to seal the bag. This system provides advantages over other common two part resealable systems as it does not require a precise or near precise alignment of the two parts (e.g. resealable systems based on zipper locking channels).

Figure 3A:
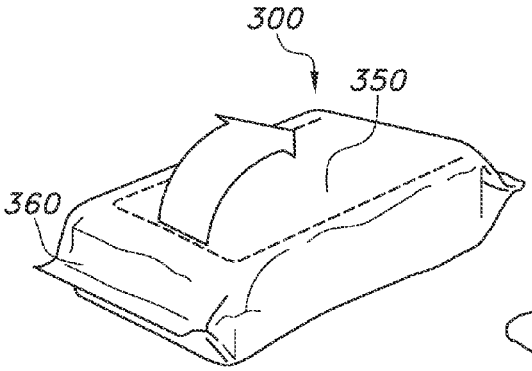
FIGS. 3A and B are representations of a packaging containing a lid and a base. The lid contains the cling coating and the base can contain the anchoring site or vice versa.
Figure 3B:
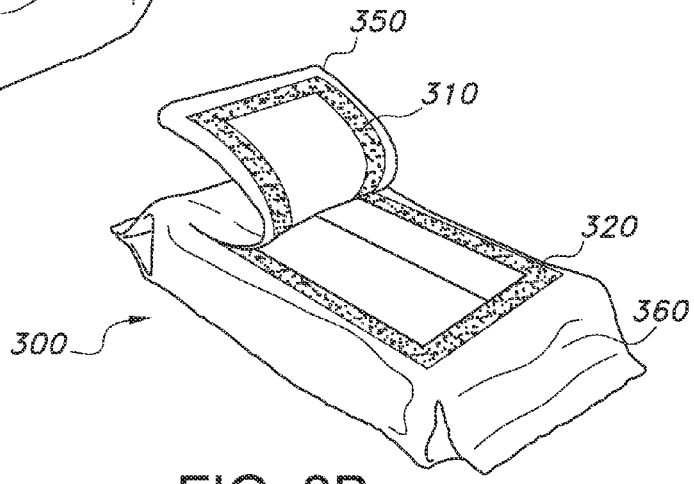
FIG. 3B, the lid is pulled away from the base, opening the packaging.

FIGS. 3A and B are representations of a packaging 300 containing a flap 350 on the top portion of the package and a base 360. For example, the flap may contain a cling coating 310 and the edge of the base that surround the opening (which is covered by the flap when the package is in the closed position) may contain the one or more anchoring sites 320, or vice versa. The flap 350 contacts with edge of the base 360 to seal the package.

Figure 4A:
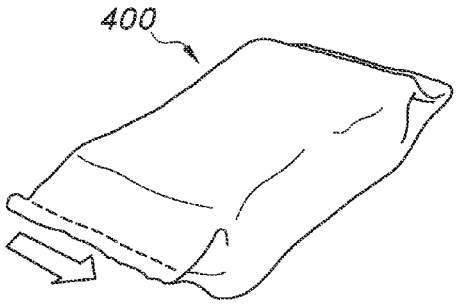
FIGS. 4A, B and C are representations of a bag where upon opening the bag by tearing, the bag has two flaps, one of which contains an anchor strip and one of which contains the cling coating.
Figure 4B:
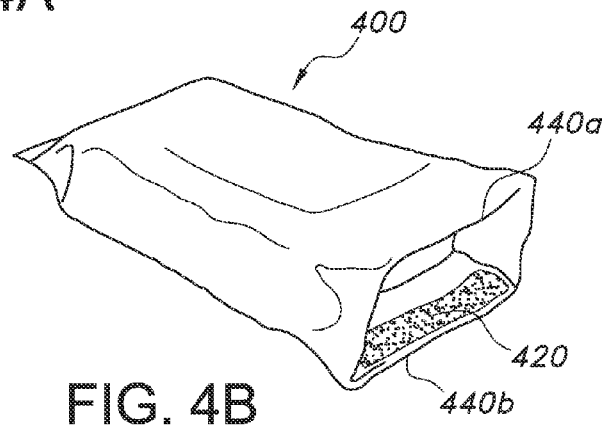
FIG. 4B, the bag is open revealing two flaps.
Figure 4C:
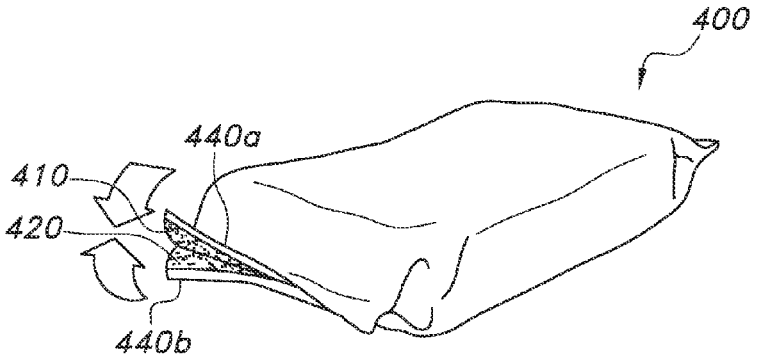
FIG. 4C, the flaps are brought into contact to seal the bag.

FIGS. 4A, B and C are representations of a bag 400, The bag may be sealed initially and have a removable edge portion that can be removed such as by tearing or cutting (see, e.g. FIG. 4A). Following the initial opening step, the bag, the bag has and upper side 440*a* and a lower side 440*b*, where an inner edge of one of the sides contains one or more anchoring sites (e.g. in the form of a strip) 420 and the corresponding inner edge of the opposite side contains the cling coating 410 (see, e.g., FIG. 4B). The inner edges of the opposite sides 440*a* and 440*b* are brought into contact with each other to seal the bag (see, e.g. FIG. 4C). Additionally, the inner edges of the opposite sides 440*a* and 440*b* can be separated from each other to open the bag.

Figure 5A:
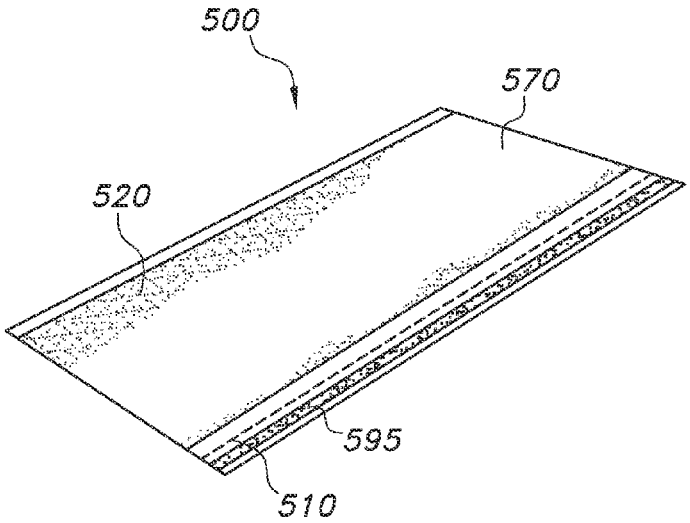
FIGS. 5A and B are representations of an exemplary method of manufacture of a resealable bag or pouch.
Figure 5B:
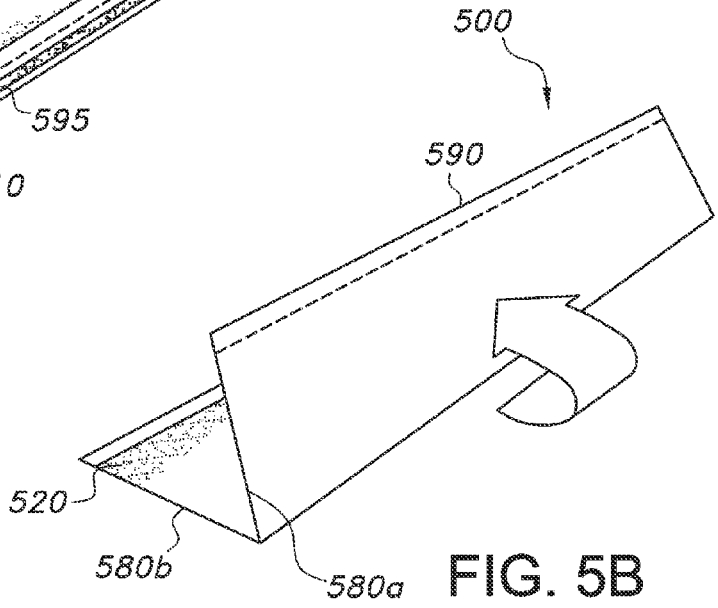
FIG. 5B is a partially folded packaging sheet.

FIGS. 5A and B are representations of the method of manufacture of a resealable bag or pouch starting from the unwrapped packaging material 500. In this example, the anchoring site 520 could be supplied to a pouch manufacturer in a narrow web with a heat seal adhesive coated or co-extruded onto the reverse side of the anchoring site 520. A suitable paper, film, or foil web may be utilized by the pouch manufacturer to form into a pouch using processes commonly used by those skilled in the art. During the pouch printing and erecting process, the cling coating 510 can be coated onto an internal side or portion 570 of the pouch. The side or portion coated with the cling coating is then folded to mate with the one or more anchoring sites and thereby forms a resealable closure. The pouch may then be completed by forming permanent closures on the sides 580*a* and 580*b*, and optionally, on top 590. A tear strip 595 can be incorporated between the top closure on the top 590 and resealable closure to allow for ease of opening by the end user.

EXAMPLES

Resealable systems were prepared containing coatings shown in Table 1. For comparison, a permanent pressure sensitive adhesive (Robond® PS-7440 available from Rohm & Haas), a removable pressure sensitive adhesive (NovaCryl® PS-R 300 available from Omnova Solutions Inc.), and a cling coating (a blend of styrene acrylic-based copolymers available from BASF, Omnova Solutions Inc., Mallard Creek Polymers, or Indulor) were evaluated at room temperature and freezer conditions.

Sample Preparation

Cling coating samples containing a 5050 weight blend of 50% wt Induprint SE 255 (supplied at 46.5% by Indulor) and 50% wt Induprint SE 3941 (supplied at 38.2% wt by Indutor), Robond® PS-7440 and Novacryl® PS-R 300 samples were coated onto bi-axially oriented polypropylene (BOPP) film facesheets using a Meyer rod bar coater with a dry target coat weight of 5 lb/3000 sq. ft. The coated facesheets were air dried at 120° F. for 10 minutes. Samples were allowed to condition at room temperature in ambient humidity overnight prior to testing.

Peel Testing

Samples of Cling coating, Roband® PS-7440 and NovaCryl® PS-R300 were cut into 1"×6" strips. Cling coated samples were applied to 2"×6" PVC-based anchoring sites containing a 50/50 weight blend of polyvinyl chloride and dioctyl phthalate.

Robond® PS-7440 and NovaCryl® PS-R 300 samples were applied to 2"×6" sheets of LDPE substrate. Samples were subjected to experimental temperature conditions including 23° C. and −20° C. for 24 hours. The quantitative peel strengths were tested at 24 hours with a modified ASTM D3330 method, where the only modification from the standard method was that the peel strength was tested with the coating on an anchoring site, not on stainless steel. Anchoring sites and PE were affixed to glass slides and the peel strength of each coating was measured at 180°.

The peel strength values shown in Table 1 were measured 24 hours following sample application under room temperature conditions. The peel strength values and coating transfer results presented in Table 2 were for samples that were applied to the substrate at room temperature, placed in a freezer (−20° C.) for 24 hours and immediately tested upon removal from the freezer.

TABLE 1

Peel test data at room temperature

| Coating | General Chemistry | Tg (° C.) | Initial application −20 (° C.) Peel Strength (g/in) | Initial application −20 (° C.) Transfer | Reapplication −20 (° C.) Peel Strength (g/in) | Reapplication −20 (° C.) Transfer |
|---|---|---|---|---|---|---|
| Robond ® PS-7440 | Acrylic | −32 | 25 | Heavy | 11 | Heavy |
| NovaCryl ® PS-R 300 | Acrylic | −37 | 5 | slight | 5 | slight |
| Cling coating | Styrene Acrylic | +5 | 278 | None | 145 | None |

TABLE 2

Peel test data at freezer temperature

| Coating | General Chemistry | Tg (° C.) | Initial application +23 (° C.) Peel Strength (g/in) | Initial application +23 (° C.) Transfer | Reapplication +23 (° C.) Peel Strength (g/in) | Reapplication +23 (° C.) Transfer |
|---|---|---|---|---|---|---|
| Robond ® PS-7440 | Acrylic | −32 | 83 | Heavy | 40 | Heavy |
| NovaCryl ® PS-R 300 | Acrylic | −37 | 6 | slight | 6 | slight |
| Cling coating | Styrene Acrylic | +5 | 88 | None | 31 | None |

The degree of coating transfer was assessed visually. Samples with no transfer had no coating residue on the anchoring site after sample removal, while slight transfer represents <15% of the surface area transferred. Moderate transfer represents 15-50% surface area transfer, while heavy transfer represents transfer levels greater than 50% of the surface area.

The reapplication performance was determined using the previously described modified ASTM D3330 quantitative peel method.

Peel strength values of 6 g/in at 23° C. and 5 g/in at −20° C. were achieved by NovaCryl® PS-R 300 coated samples. NovaCryl® PS-R 300 samples were shown to present slight levels of coating transfer to substrate. Subsequent reapplications of NovaCryl® PS-R 300 coated samples yielded quantitative peel performance values of 6 g/in at 23° C. and 5 g/in at −20° C. As witnessed during the first application cycle, reapplied NovaCRYL® PS-R 300 coated samples exhibited slight levels of coating transfer to the substrate when re-exposed to either 23° C. or −20° C.

Robond® PS-7440 samples yielded peel strength values of 83 g/in at 23° C. and 25 g/in at −20° C., with heavy coating transfer to substrate. Subsequent reapplications of Robond® PS-7440 coated samples yielded quantitative peel performance values of 40 g/in at 23° C. and 11 in at −20° C. Reapplied Robond® PS-7440 coated samples exhibited heavy amounts of coating transfer to the substrate when re-exposed to either 23° C. or −20° C.

Cling coated samples yielded peel strength values of 88 g/in at 23° C. and 278 g/in at −20° C., with no transfer of coating to the substrate. Subsequent reapplications of Cling coated samples yielded quantitative peel performance values of 31 g/in at 23° C. and 145 g/in at −20° C. Furthermore, reapplied cling coated samples presented no transfer to the substrate when re-exposed to either 23° C. or −20° C.

Unless defined otherwise, all technical and scientific terms used herein have the same meanings as commonly understood by one of skill in the art to which the disclosed invention belongs. Publications cited herein and the materials for which they are cited are specifically incorporated by reference.

Those skilled in the art will recognize, or be able to ascertain using no more than routine experimentation, many equivalents to the specific embodiments of the invention described herein. Such equivalents are intended to be encompassed by the following claims.

We claim:

1. A resealable packaging, comprising a first portion comprising one or more anchoring sites, and a second different portion comprising one or more cling coatings, wherein the one or more cling coatings and the one or more anchoring sites interact via cohesive forces, wherein the one or more cling coatings comprise a first polymer selected from the group consisting of polyvinyl alcohol homopolymer, polystyrene homopolymer, polystyrene acrylic consisting of styrene and acrylic monomers, and combinations thereof; and wherein the one or more anchoring sites comprise a second polymer, wherein the second polymer is polyvinyl chloride;

wherein the one or more cling coatings attach only to the one or more anchoring sites, and do not attach to themselves or other materials, and wherein the first portion and the second portion are on opposite sides of an opening on the resealable packaging, or wherein the first portion and the second portion are each on an outer surface of the packaging and are on opposite sides of the resealable packaging.

2. The resealable packaging of claim 1, comprising a plurality of flaps, wherein at least one flap is aligned with a corresponding second flap on the opposite side of the packaging to form a pair of flaps, and wherein the first portion and the second portion are on opposite flaps of the pair of flaps.

3. The resealable packaging of claim 1, wherein the one or more anchoring sites further comprise a plasticizer.

4. The resealable packaging of claim 3, wherein the plasticizer is selected from the group consisting of diisobutyl adipate, diisodecyl adipate, acetyl tributly citrate, di-isononyl-cyclohaxane-1,2-dicarboxylate, dioctyl terephthalate, epoxidized soybean oil, tri-2-ethylhexyl trimellitate, acetylated monoglycerides of fully hydrogenated castor oil, bis(2-ethylhexyl)-1,4-benzenedicarboxylate, di(2-ethyl hexyl) adipate, di-butyl adipate, butylated hydroxytoluene, hyperbranched poly(ϵ-caprolactone), di(2-ethylhexyl) phosphate, 2,2,4-trimethyl 1,3-pentanediol diisobutyrate, dioctyl sebacate, and di-butyl sebacate.

5. The resealable packaging of claim 3, wherein the ratio by weight of the polymer to plasticizer for the one or more anchoring ranges from 20:80 to 80:20.

6. The resealable packaging of claim 1, wherein the packaging is food packaging.

7. The resealable packaging of claim 1, wherein the packaging is non-food packaging.

8. The resealable packaging of claim 1, wherein the hardness of the one or more anchoring sites as measured using a Rex durometer model 1000 A ranges from Shore A40-75.

9. A method of sealing a resealable packaging, wherein the resealable packaging comprises a first portion comprising one or more anchoring sites, and a second different portion comprising one or more cling coatings, wherein the one or more cling coatings and the one or more anchoring sites interact via cohesive forces, wherein the one or more cling coatings comprise a first polymer selected from the group consisting of polyvinyl alcohol homopolymer, polystyrene homopolymer, polystyrene acrylic consisting of styrene and acrylic monomers, and combinations thereof; and wherein the one or more anchoring sites comprise a second polymer, wherein the second polymer is polyvinyl chloride, and wherein the first portion and the second portion are on opposite sides of an opening on the resealable packaging, or wherein the first portion and the second portion are each on an outer surface of the packaging and are on opposite sides of the resealable packaging, wherein the method comprises:

(a) contacting the one or more cling coatings with the one or more anchoring sites;

wherein the one or more cling coatings attach only to the one or more anchoring sites, and do not attach to themselves or other materials.

10. The method of claim 9, wherein the one or more anchoring sites comprise an adhesive to permanently affix one side of the one or more anchoring sites to the packaging.

11. The method of claim 9, wherein the one or more anchoring sites are permanently affixed to the packaging after the packaging is manufactured.

12. The method of claim 9, wherein the one or more anchoring sites are introduced into the packaging during manufacturing of the packaging.

13. The method of claim 9, further comprising (b) separating the one or more cling coatings from the one or more anchoring sites.

14. The method of claim 13, further comprising repeating steps (a) and (b) multiple times.

* * * * *